US005211108A

United States Patent [19]

Gore et al.

[11] Patent Number: 5,211,108

[45] Date of Patent: May 18, 1993

[54] TRUSS ASSEMBLY APPARATUS WITH VERTICALLY ADJUSTABLE PRESS ROLLER

[75] Inventors: Charles E. Gore, Colleyville; Edward Hardee, Bedford; Frank E. Fairley, Jr.; Harry E. Berney, Jr., both of Arlington, all of Tex.

[73] Assignee: Truswal Systems Corporation, Arlington, Tex.

[21] Appl. No.: 608,244

[22] Filed: Nov. 2, 1990

[51] Int. Cl.[5] ..... B30B 15/16; B30B 3/02

[52] U.S. Cl. ..... 100/48; 100/210; 100/913; 227/4; 29/432

[58] Field of Search ..... 100/46, 48, 170, 210, 100/913, 47, 155 R, 168, 169, 171, 901; 227/4; 156/358; 29/432, 798; 72/207, 237; 384/256, 295, 419, 428, 435; 294/67.33, 81.54; 414/591, 273; 474/135; 901/13

[56] References Cited

U.S. PATENT DOCUMENTS

| | | | |
|---|---|---|---|
| 730,368 | 6/1903 | Hampp | 100/210 |
| 959,667 | 5/1910 | White | 474/135 |
| 2,058,760 | 10/1936 | Barber | 384/428 |
| 2,098,573 | 11/1937 | Dingle | 474/135 |
| 2,239,986 | 4/1941 | Blood | 384/428 |
| 3,119,009 | 1/1964 | Zeller | 901/13 |
| 3,212,694 | 10/1965 | Sanford | 100/210 |
| 3,255,943 | 6/1966 | Sanford | 100/913 |
| 3,336,865 | 8/1967 | Brand | 100/210 |
| 3,527,159 | 9/1970 | Edwards | 100/170 |
| 3,538,843 | 11/1970 | Lubin | 100/913 |
| 3,542,622 | 11/1970 | Brinkman | 100/170 |
| 3,545,827 | 12/1970 | McDermott | 384/256 |
| 3,591,067 | 7/1971 | Vial | 227/4 |
| 3,855,917 | 12/1974 | Farrell | 100/913 |
| 4,220,492 | 9/1980 | Lenhardt | 100/48 |
| 4,295,269 | 10/1981 | Wright | 100/913 |
| 4,301,721 | 11/1981 | Liessen | 100/170 |
| 4,437,234 | 3/1984 | Thornton | 100/913 |
| 4,637,741 | 1/1987 | Gillet | 384/428 |
| 4,984,516 | 1/1991 | Scalzitti | 100/210 |

FOREIGN PATENT DOCUMENTS

| | | | |
|---|---|---|---|
| 2211123 | 6/1989 | United Kingdom | 100/901 |

*Primary Examiner*—Harvey C. Hornsby
*Assistant Examiner*—Terrence R. Till
*Attorney, Agent, or Firm*—W. Kirk McCord

[57] ABSTRACT

A truss assembly machine includes an elongated table for supporting truss members, including a plurality of wood members and a plurality of connector plates, and a pressing roller mounted for rotation about its own axis on a movable gantry above the support table. The gantry transports the roller longitudinally along the table for engaging the connector plates to embed the plates into the wood members and form the completed truss. A hydraulic cylinder with a hydraulically actuated piston carried therein is coupled to each end of the roller for selectively lifting and lowering the roller. When the gantry stops after completion of a pressing operation, the pistons are automatically actuated for lifting the roller a predetermined distance above its normal operating position to permit the completed truss to be moved along the support table and underneath the elevated roller, thereby allowing the truss to be discharged at one end of the support table without having to move the gantry back to the opposite end of the table. The roller remains in an elevated position until the hydraulic system is actuated by means of a manually operable switch for returning the roller to its normal operating position.

8 Claims, 5 Drawing Sheets

TRUSS ASSEMBLY APPARATUS WITH VERTICALLY ADJUSTABLE PRESS ROLLER

FIELD OF THE INVENTION

This invention relates generally to truss assembly apparatus and in particular to an apparatus for selectively raising and lowering the press roller in a truss assembly machine.

BACKGROUND OF THE INVENTION

Truss assembly machines having conventional gantry truss rollers are in common use in the truss industry. The wooden truss members are assembled on a table or other support surface with toothed connector plates partially embedded into the wooden truss members at the respective truss joints. A gantry roller press then rolls over the top of the truss to press the connector plates into the wooden truss members. A gantry roller press may include a single pressing roller positioned above the truss, as disclosed in U.S. Pat. No. 4,084,498, or a pair of rollers respectively positioned above and below the truss, as disclosed in U.S. Pat. No. 3,855,917.

After the pressing operation is complete, the assembled truss is discharged from the support table by a conveyor system positioned at one end of the support table or alongside thereof. If the gantry press is at a position between the assembled truss and the end of the support table at which the conveyor system is located, the gantry press must be moved toward the opposite end of the support table to allow the truss to be discharged from the support table. The time it takes to move the gantry press out of the way delays the discharge of the assembled truss, which in turn delays commencement of the next truss assembly operation. A significant loss of time and productivity occurs over the course of a working day.

Instead of discharging the assembled truss at one of the truss table, it is also known in the art to position the conveyor system alongside the truss table, so that the assembled truss can be discharged off the side of the truss table without the necessity of moving the gantry press. Positioning a conveyor system alongside the truss table saves time associated with moving the gantry press, but has the disadvantage of taking up valuable work space at the truss assembly site. The need therefore exists in the art for an improved and more efficient gantry roller press for assembling wooden trusses.

OBJECTS OF THE INVENTION

It is, therefore, the principal object of the present invention to provide an improved gantry roller press for assembling wooden trusses.

Another object of the invention is to enhance the efficiency of truss assembly operations using a gantry roller press.

Yet another object of the invention is to provide an improved gantry roller press in which the pressing roller is vertically adjustable to provide sufficient clearance for the assembled truss to be discharged from a truss support table beneath the gantry press.

SUMMARY OF THE INVENTION

These and other objects are accomplished in accordance with the present invention wherein apparatus is provided for assembling truss members into a completed truss. The truss members included a plurality of wood members and a plurality of connector plates for joining the wood members. The apparatus is comprised of support means for supporting the truss members with the connector plates at respective positions on the wood members, a pressing roller mounted for rotation about its own axis above the support means first and second bearings at respective opposite ends of the roller for supporting the roller and for allowing the roller to rotate about its own axis, and moving means for moving the roller over the top of the truss members. The roller is adapted to embed the connector plates into the wood members when the roller is moved over the top of the truss members, to form the completed truss. The roller is moveable along a vertical axis between a first predetermined position for engaging the connector plates and a second predetermined position a predetermined distance above the first predetermined position. Each of the first and second bearings has a pair of recesses on respective opposite sides thereof.

In accordance with a unique feature of the invention, retaining means is provided for retaining the roller in the first predetermined position while the roller is in pressing engagement with the connector plates. The retaining means includes a plurality of pin members insertable into the respective recesses of the first and second bearings to maintain the roller in the first predetermined position. The pin members are retractable from the respective recesses of the first and second bearings to permit the roller to be lifted to the second predetermined position.

In accordance with another unique feature of the invention, arresting means is provided for automatically arresting the movement of the moving means in response to the pressing roller reaching a predetermined position with respect to the support means. The apparatus further includes lifting means responsive to the cessation of movement of the roller over the top of the truss members for lifting the roller, to permit the completed truss to be moved along the support means and beneath the roller. The lifting means includes means for automatically disabling the retaining means in response to the cessation of movement of the roller over the top of the truss members to release the roller for movement to the second predetermined position. Engagement means is further provided for automatically enabling the retaining means to engage the roller when the roller is lowered to the first predetermined position.

In one embodiment, the arresting means includes limit switch means mounted on the moving means and a stop member located at the predetermined position with respect to the support means for activating the limit switch means when the limit switch means comes into contact with the stop member. The activation of the limit switch means automatically arrests the movement of the moving means.

In accordance with a further unique feature of the invention, the apparatus includes drive means for rotating a roller bout its own axis. The drive means includes a drive sprocket and drive chain coupled between the drive sprocket and the roller. The apparatus further includes take-up means for taking up slack in the chain when the roller is lifted. In one embodiment, the take-up means includes an arm member, first and second idler wheels at respective opposite ends of the arm member and means for pivotally mounting the arm member at a position intermediate the wheels. The wheels are in contact with the drive chain to exert tension thereon. Means is provided for pivoting the arm member to maintain the wheels in contact with the drive chain to take up the slack on the drive chain when the roller is lifted. In another embodiment, the means for pivoting the arm member includes a spring member coupled to one of the wheels for biasing both of the wheels in contact with the drive chain.

In the preferred embodiment, the support means includes an elongated table for supporting the truss members. The moving means includes a gantry moveable along respective parallel tracks on opposite sides of the table for transporting the roller longitudinally along the table. The lifting means includes first and second hydraulic cylinders having respective first and second double acting pistons carried therein. The pistons are actuated in responsive to hydraulic pressure. The first and second double acting pistons are coupled to the respective first and second bearings for selectively lifting and lowering the first and second bearings and the roller. First hydraulic actuator means is provided for selectively lifting and lowering the first and second bearings and the roller and second hydraulic actuator means is provided for selectively inserting the pin members into and retracting the pin members form the respective recesses. The first and second hydraulic actuator means have a common source of hydraulic pressure. Control means is provided for controlling the source of hydraulic pressure to supply hydraulic pressure to a selected one of the first and second hydraulic actuator means.

In operation, the pressing roller is moved over the top of the truss members to embed the connector plates into the wood members to form the completed truss. The pressing roller is maintained in the first predetermined position for pressing the connector plates into the wood members by the engagement between the pin members and the respective recesses of the first and second bearings. When the moving means reaches the predetermined position with respect to the support means, the arresting means automatically arrests further movement of the moving means. Hydraulic pressure is then used to retract the pin members from the respective recesses, so that the pressing roller can be elevated to the second predetermined position to allow the completed truss to pass beneath the pressing roller. When the pin members have been fully retracted, hydraulic pressure is used to actuate first and second pistons coupled to respective opposed ends of the roller, thereby elevating the roller to the second predetermined position.

To resume the pressing operation for the next truss in sequence, a manually operable switch is used to activate the hydraulic system to return the pressing roller back to the first predetermined position for pressing. When the roller has been lowered to the first predetermined position, hydraulic pressure is used to reinsert the pin members to maintain the roller in its operative position for engaging the connector plates.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

Figure 1:
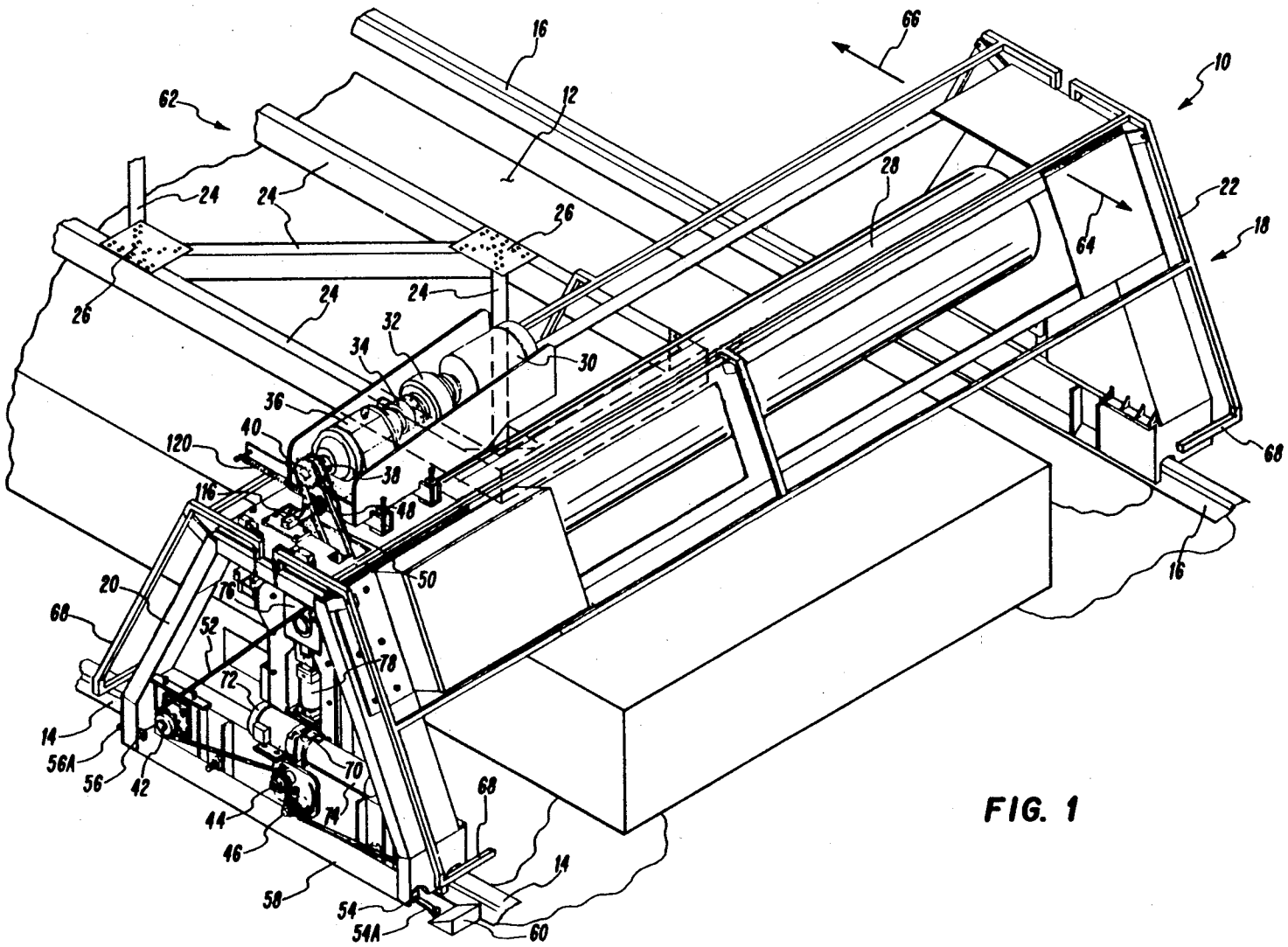
FIG. 1 is a perspective view of a truss assembly apparatus according to the present invention.

In the description which follows, like parts are indicated throughout the specification and drawings with the same reference numerals, respectively. The drawings are not necessarily to scale and proportions of certain parts have been exaggerated to better illustrate details of the present invention.

Referring to FIG. 1, a truss assembly apparatus 10, according to the present invention includes an elongated table 12, parallel rails 14 and 16 running along respective opposite sides of table 12, and a self-propelled gantry 18 spanning table 12, and having opposed side frames 20 and 22 in engagement with the respective rails 14 and 16. Gantry 18 is movable in either direction along parallel rails 14 and 16, so that gantry 18 is movable along a longitudinal axis of table 12.

To begin the truss assembly operation, the truss members, including a plurality of wood members 24 and a plurality of toothed metal connector plates 26, are positioned on table 12, such that connector plates 26 are positioned on top of wood members 24 at the respective truss joints and are partially embedded into wood members 24. Gantry 18 includes a transversely extending pressing roller 28, which is mounted for rotation about its own axis above table 12. Gantry 18 is movable along parallel rails 14 and 16 for transporting roller 28 longitudinally along table 12 for engaging connector plates 26 to substantially completely embed connector plates 26 into wood members 24.

Gantry 18 is propelled along rails 14 and 16 and roller 28 is rotated about its own axis by means of a common drive system, which includes an electric drive motor 30, a fluid coupling 32 for cushioned starting, a brake 34, a reduction gear 36 and a chain and sprocket drive, which includes drive sprockets 38 and 40, driven sprockets 42, 44 and 46 and drive chains 48, 50 and 52.

A pair of limit switches 54 and 56 are disposed on respective bottom parts of side frame 20, such that the respective actuator members 54*a* and 56*a* thereof extend below a bottom edge 58 of side frame 20. A stop member 60 is located in a fixed position adjacent to a rail 14 for contacting actuator member 54*a* when gantry 18 is in the position shown in FIG. 1. When actuator member 54*a* contacts stop member 60, limit switch 54 is closed, thereby generating an electrical signal which disables motor 30 and activates brake 34 to arrest the movement of gantry 18. Stop member 60 is positioned, so that gantry 18 will be stopped after roller 28 has completed its pass over the top of truss 62 in the direction indicated by arrow 64 in FIG. 1 and after connector plates 26 have been fully embedded into wood members 24. Although not shown in FIG. 1, another stop member will be positioned adjacent to rail 14 in the opposite direction from that indicated by arrow 64 for engaging actuator arm 56*a* to arrest the movement of gantry 18 when gantry 18 is moved in an opposite direction, as indicated by arrow 66. Gantry 18 can also be stopped by means of a manual brake 68, so that in the event of an emergency or other abnormal condition, gantry 18 can be stopped at any position along table 12. Activating manual brake 68 completely disables the operation of gantry 18, so that gantry 18 must be manually restarted.

Roller 28 is selectively raised and lowered by means of a hydraulic system, which includes a hydraulic pump 70, which is driven by an electric motor 72, and a reservoir 74, which acts as a source of hydraulic fluid. Pump 70 is preferably a multiposition pump which is controllable for supplying hydraulic fluid to various components of apparatus 10, as will be described in greater detail hereinafter.

Figure 3:
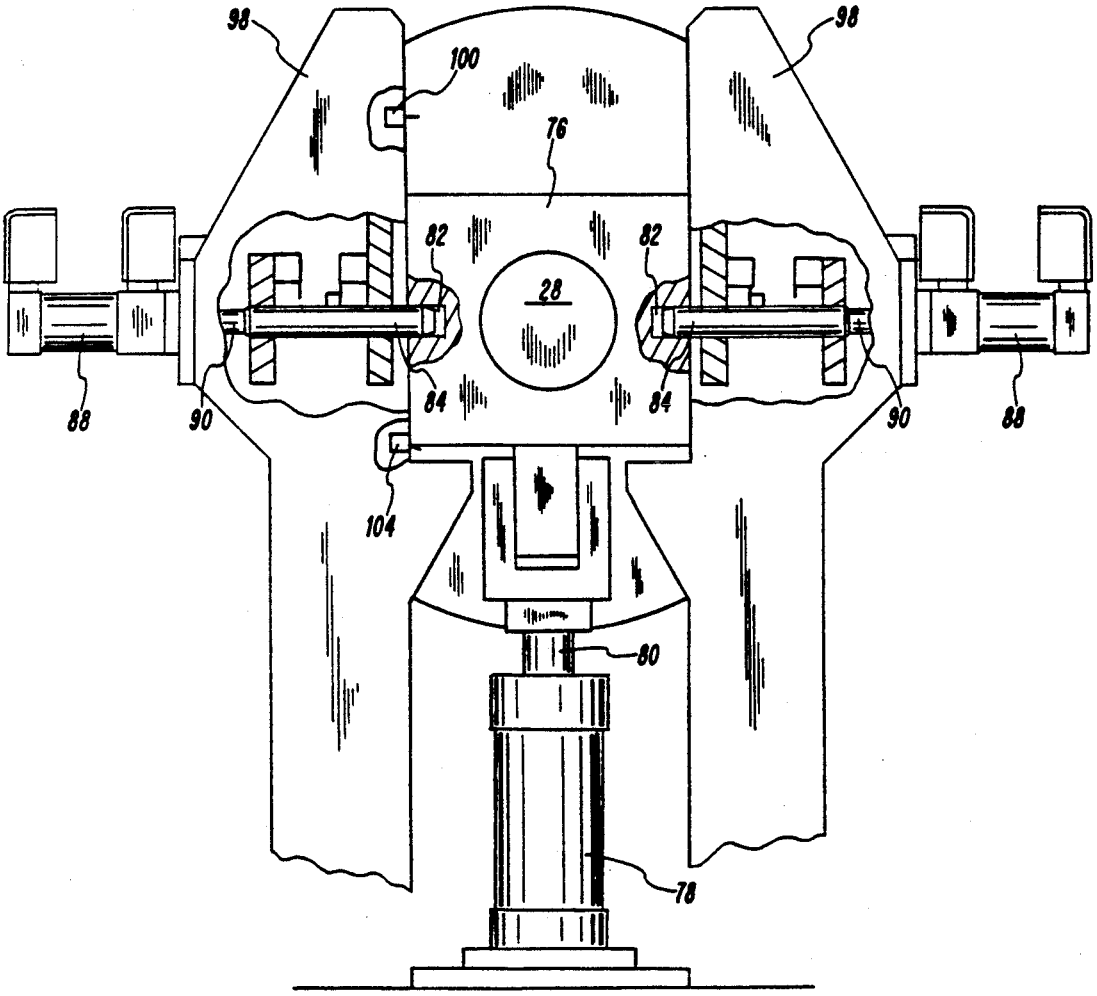
FIG. 3 is a side elevation view of a portion of the truss assembly apparatus of FIG. 1, illustrating a pressing roller in an operative position for pressing metal connector plates into the wood members of the truss.
Figure 4:
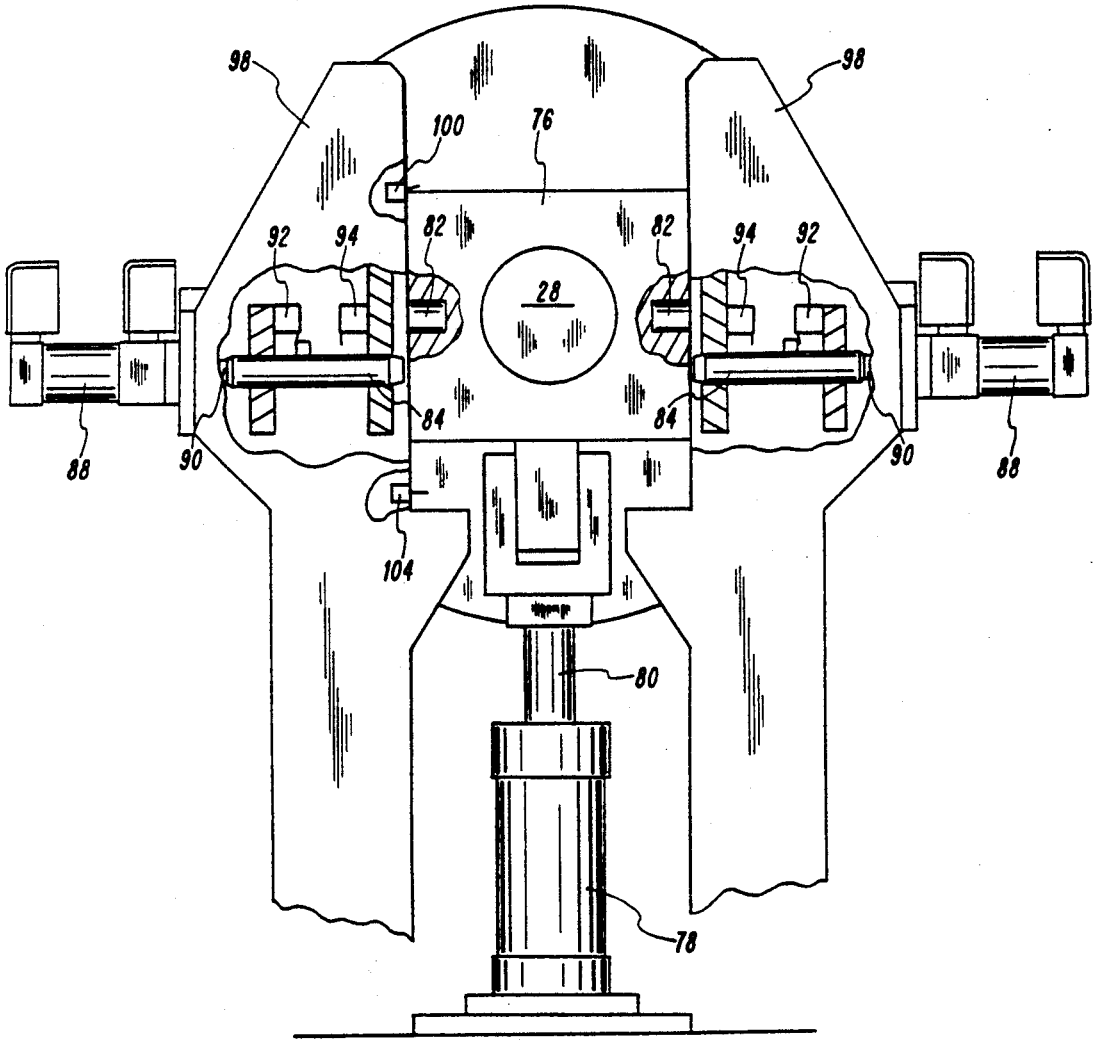
FIG. 4 is a side elevation view of the same portion of the truss assembly apparatus shown in FIG. 3, showing the pressing roller in an elevated position.

Referring also to FIGS. 3 and 4, roller 28 is supported at respective opposite ends thereof by bearing blocks 76, only one of which is shown. A hydraulic cylinder 78 having a piston 80 carried therein for being actuated by hydraulic fluid pressure is coupled to each of the bearing blocks 76. As best seen in FIGS. 3 and 4, blocks 76 have respective recesses 82 on opposite sides thereof for receiving respective pairs of locking pins 84. Locking pins 84 are inserted into recesses 82 to maintain roller 28 in a first predetermined position, which corresponds to a normal operating position of roller 28 for pressing connector plates 26 into wood members 24 when roller 28 is moved over the top of truss 62. Roller 28 cannot be raised without first retracting locking pins 84 from recesses 82.

FIG. 3 illustrates the lowermost position of blocks 76 and roller 28, wherein roller 28 is positioned to engage connector plates 26. FIG. 4 illustrates the uppermost position of blocks 76 and roller 28 after locking pins 84 have been retracted and blocks 76 and roller 28 have been raised by the upward movement of pistons 80.

When apparatus 10 is in operation, gantry 18 is in motion along rails 14 and 16 for transporting roller 28 over the top of truss 62. Roller 28 is rotated about its own axis for pressing connector plates 26 into the wood members 24 to form the truss 62. Roller 28 is maintained in an operative position for engaging connector plates 26 by locking pins 84, which are fully inserted into the respective recesses 82, as shown in FIG. 3.

Figure 2:
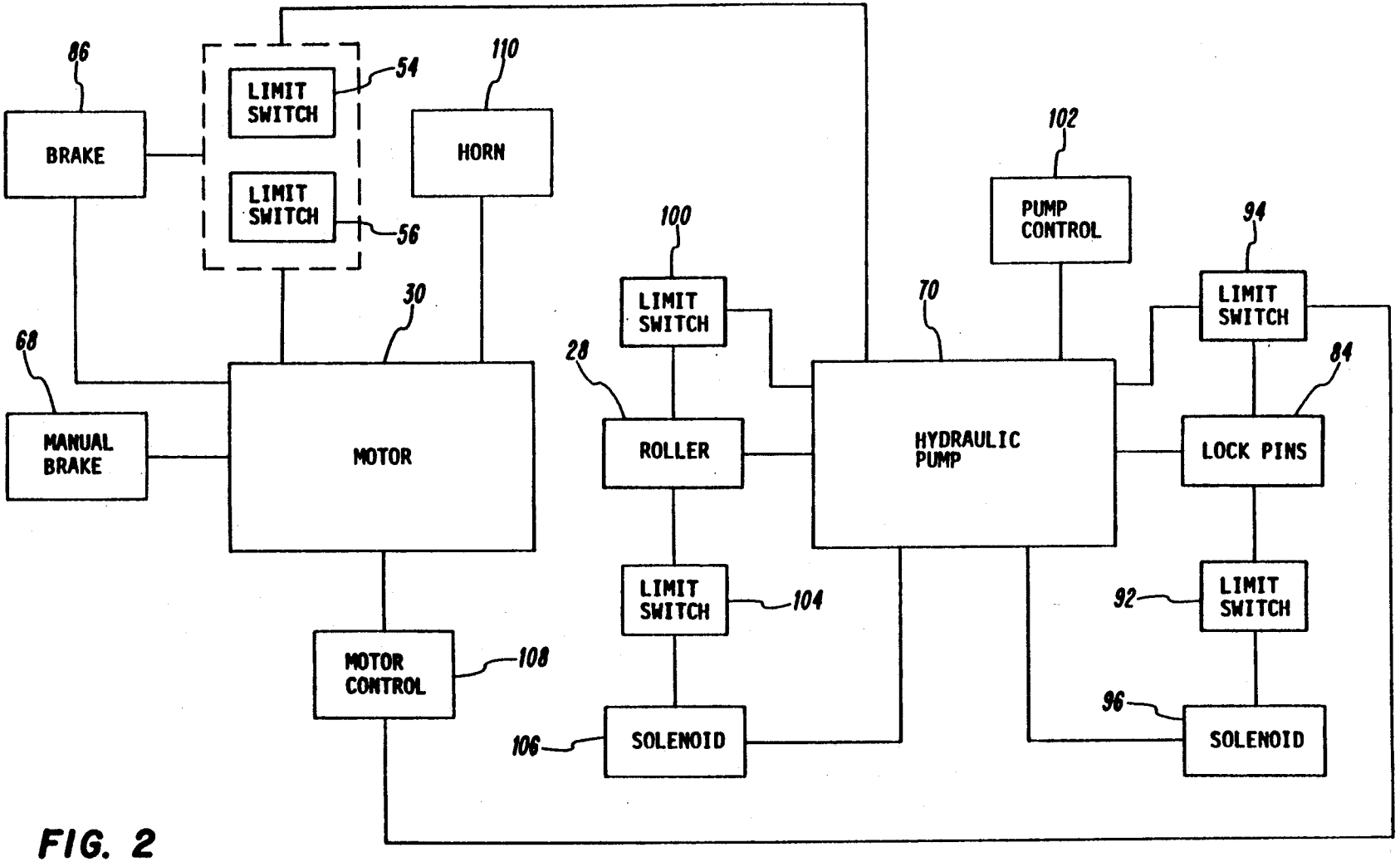
FIG. 2 is a functional block diagram of the major components of the truss assembly apparatus of FIG. 1.

Referring also to FIG. 2, when limit switch 54 or 56 is activated by contact with stop member 60, motor 30 is deactivated and brake 86 is applied to arrest the movement of gantry 18. Deactivation of motor 30 disables the entire drive system, which also stops the rotary motion of roller 28. The activation of limit switch 54 or 56 automatically activates hydraulic pump 70, which directs hydraulic fluid to respective hydraulic cylinders 88 having respective hydraulic pistons 90 carried therein. Pistons 90 are attached to the respective locking pins 84 for moving pins 84 into and out of engagement with the corresponding recesses 82. When pump 70 is activated, hydraulic fluid pressure is introduced into the cylinders 88 to move pistons 90 and locking pins 84 away from the respective blocks 76, so that locking pins 84 are retracted from the corresponding recesses 82. A pair of limit switches 92 and 94 are associated with each of the locking pins 84 for limiting the reciprocal movement of locking pins 84 in each direction. When locking pins 84 are retracted, the corresponding limit switches 92 will be activated by contact with the respective locking pins 84, thereby indicating that locking pins 84 have been fully retracted. Activation of limit switches 92 in turn activates a solenoid 96, which reverses the position of hydraulic pump 70, so that pump 70 can now direct hydraulic fluid to hydraulic cylinders 78 for lifting roller 28. One skilled in the art will appreciate that the lifting operation will not commence until locking pins 84 have been fully retracted from recesses 82 to permit blocks 76 and roller 28 to be lifted.

The hydraulic pressure introduced into cylinders 78 actuates pistons 80 for moving blocks 76 upwardly within respective semi-enclosed housings 98 until blocks 76 contact respective limit switches 100 in respective upper portions of housings 98. Limit switches 100 define the upper limits of movement of blocks 76. An electrical signal generated by the closure of limit switches 100 indicates that roller 28 is in a fully elevated position. The completed truss 62 can then be discharged from table 12 by moving it beneath the elevated roller 28 in the direction of arrow 64 in FIG. 1.

When the completed truss has been discharged from table 12, the truss assembly operation is resumed for the next truss in sequence by manually starting hydraulic pump 70 by means of a pump control switch 102. Pump 70 introduces hydraulic fluid into cylinders 78 for moving the respective pistons 80 in an opposite direction to lower roller 28 back to its normal operating position for engaging connector plates 26. A limit switch 104 is positioned in a lower portion of each housing 98 for defining the lowermost position of the corresponding block 76. When blocks 76 contact the corresponding limit switch 104, limit switches 104 are closed to generate an electrical signal indicating that roller 28 has been returned to its normal operating position. The closure of limit switches 104 also activates a solenoid 106 for changing the position of hydraulic pump 70, such that hydraulic pump 70 will automatically direct hydraulic fluid to the cylinders 88 for re-inserting locking pins 84 into the respective recesses 82. Limi switch 94 is activated by the respective locking pins 84 when pins 84 are fully inserted into corresponding recesses 82. An electrical signal generated by the closure of limit switch 94 indicates that locking pins 84 are in place for retaining roller 28 in its normal operating position.

Motor 30 is manually restarted by pressing a motor control switch 108. Motor 30 operates the chain and sprocket drive for rotating roller 28 about its own axis and for moving gantry 18 along parallel rails 14 and 16. When motor 30 is in operation and gantry 18 is in motion, a horn 110 is sounded to alert the operator and others in the vicinity that gantry 18 is in motion. During the next truss assembly cycle, gantry 18 will be moved in an opposite direction (i.e., the direction of arrow 66 in FIG. 1). When the next cycle is complete, gantry 18 will be at an opposite end of table 12 and the newly completed truss can be discharged from table 12 in the direction of arrow 64 in FIG. 1 without having to elevate roller 28. Motor control switch 108 includes both a forward and a reverse position to enable the operator to select the direction in which gantry is to be moved.

As previously mentioned, the truss assembly operation can be aborted at any time by applying brake 68, which disables drive motor 30 and stops the movement of gantry 18 and the rotary motion of roller 28 in substantially the same manner that drive motor 30 is disabled by the closure of either limit switch 54 or 56 at the end of each truss assembly cycle. When manual brake 68 is applied, however, hydraulic pump 70 is not activated for automatically lifting roller 28, as is the case when the movement of gantry 18 is arrested by closure of limit switch 54 or 56. Pump control switch 102 is also a dual position switch for allowing the operator to manually control hydraulic pump 70 to selectively raise and lower roller 28.

Figure 5:
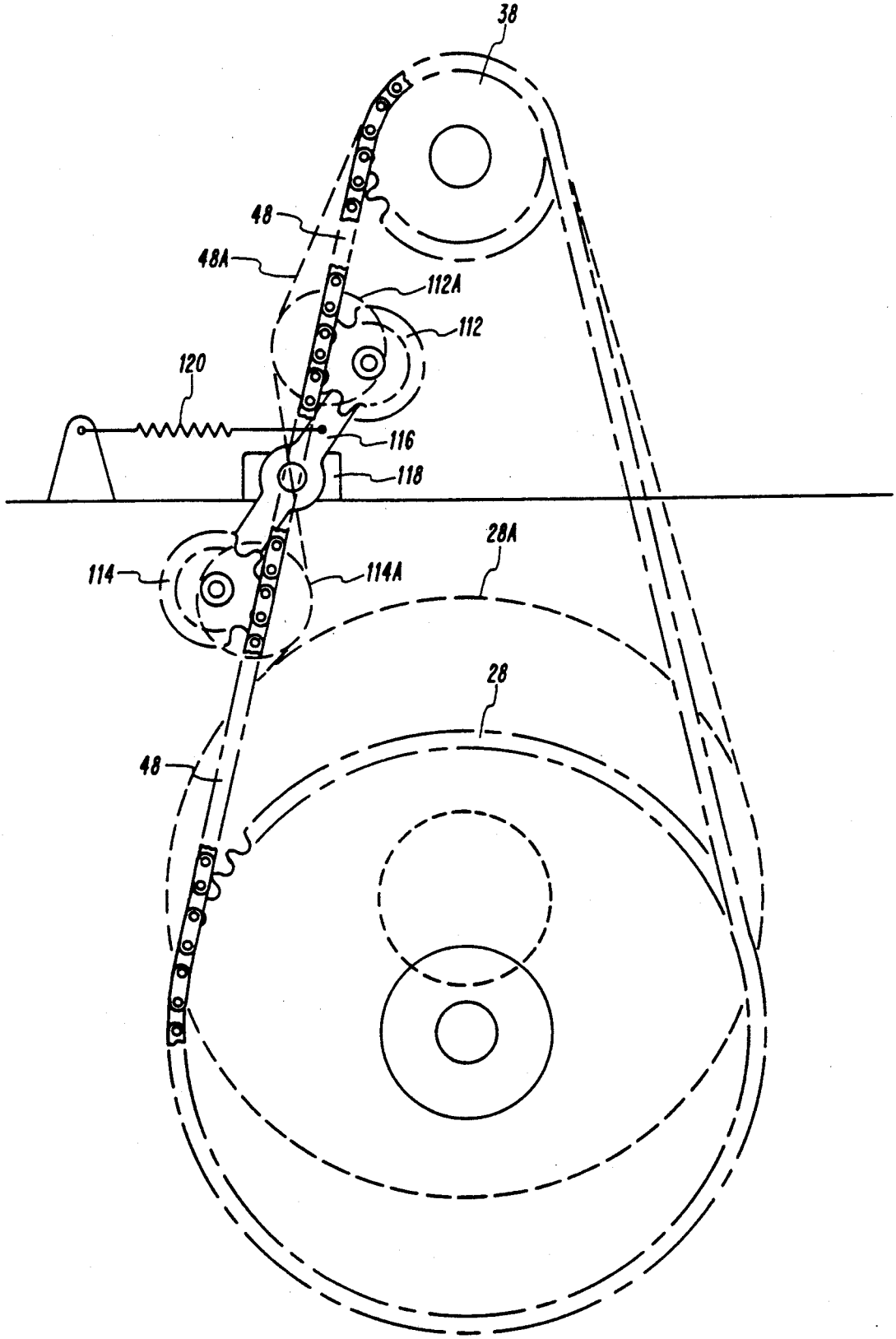
FIG. 5 is a side elevation view of the roller drive system, including means for taking up slack in the drive chain as the roller is elevated.

In accordance with another unique feature of the invention, as shown in FIG. 5, relatively constant tension is maintained on roller drive chain 48 by means of two idler wheels 112 and 114, which are maintained in contact with chain 48. Wheels 112 and 114 are mounted on respective opposite ends of an elongated arm member 116, which is pivotally mounted on a block 118 at an intermediate position with respect to the wheels 112 and 114. Tension spring 120 is affixed to wheel 112 for exerting a biasing force thereon tending to rotate wheels 112 and 114 and arm member 116 in a counterclockwise direction, as viewed in FIG. 5. When roller 28 is in its normal operating position, the tension of chain 48 acting on wheels 112 and 114 will overcome the spring bias tending to rotate arm member 116 counterclockwise. When roller 28 is lifted toward drive sprocket 38, as indicated at 28*a*, chain 48 will slacken as the tension is released. The biasing force exerted by spring 120 on wheel 112 will rotate arm member 116 counterclockwise to take up the slack in drive chain 48. The new positions of wheels 112 and 114 are indicated as 112*a* and 114*a*, respectively, and the new position of drive chain 48 is indicated at 48*a*, after roller 28 is moved to an elevated position.

In accordance with the present invention, truss assembly operations using a gantry press are enhanced by substantially reducing the cycle time between successive assembly operations. By automatically raising the pressing roller when the gantry has stopped, the completed truss can be discharged from the support table beneath the elevated roller, thereby eliminating the necessity of moving the gantry back to the opposite end of the table to allow the completed truss to be discharged therefrom. The completed truss can be discharged at one end of the table, which eliminates the need for a side discharge table, thereby conserving valuable working space. The roller is lifted automatically by hydraulic pressure when the gantry is stopped upon reaching a predetermined position relative to the support table, which further enhances the efficiency of the overall operation by eliminating the need to manually initiate the lifting operation. Furthermore, experimentation is shown that the lifting action is best accomplished by means of hydraulic power, rather than by alternative power sources, such as pneumatic power.

Although the invention has been described with reference to a specific embodiment, the foregoing description is not intended to be construed in a limiting sense. Various modifications to the disclosed embodiment as well as alternative applications of the invention will be suggested to persons skilled in the art by the foregoing specification and illustrations and it is therefore contemplated that the appended claims will cover any such modifications, applications or embodiments as fall within the true scope of the invention.

What is claimed is:

1. Apparatus for assembling truss members into a completed truss, the truss members including a plurality of wood members and a plurality of connector plates for joining the wood members, said apparatus comprising, in combination:

support means for supporting the truss members with the connector plates at respective positions on the wood members;

a pressing roller mounted for rotation about its own axis above said support means, said roller being moveable along a vertical axis between a first predetermined position for engaging the connector plates and a second predetermined position at a predetermined distance above said first predetermined position;

first and second bearings at respective opposite ends of said roller for supporting said roller and for allowing said roller to rotate about its own axis, each of said first and second bearings having a pair of recesses on respective opposite sides of said first and second bearings;

moving means for moving said roller over the top of the truss members, said roller being adapted to embed the connector plates into the wood members as said roller is moved over the top of the truss members, to form the completed truss;

retaining means for retaining said roller in said first predetermined position when said roller is in pressing engagement with the connector plates, said retaining means including a plurality of pin members insertable into the respective recesses of said first and second bearings to maintain said roller in said first predetermined position, said pin members being retractable from the respective recesses of said first and second bearings to permit said roller to be lifted to said second predetermined position;

arresting means for automatically arresting the movement of said moving means in response to said pressing roller reaching a predetermined position with respect to said support means;

lifting means responsive to the cessation of movement of said roller over the top of the truss members for lifting said roller, to permit the completed truss to be moved along said support means and beneath said roller, said lifting means including means for automatically disabling said retaining means in response to the cessation of movement of said roller over the top of the truss members to release said roller for movement to said second predetermined position; and engagement means for automatically enabling said retaining means to engage said roller when said roller is lowered to said first predetermined position.

2. The apparatus of claim 1 wherein said lifting means includes first and second hydraulic cylinders having respective first and second double acting positions carried therein, said first and second double acting pistons being actuatable in response to hydraulic pressure, said first and second double acting positions being coupled to the respective first and second bearings for selectively lifting and lowering said first and second bearings and said roller.

3. The apparatus of claim 1 further including first and second hydraulic actuator means for selectively lifting and lowering said first and second bearings and said roller and second hydraulic actuator means for selectively inserting said pin members into and retracting said pin members from the respective recesses, said first and second hydraulic actuator means having a common source of hydraulic pressure, said apparatus further including means for controlling said common source to supply hydraulic pressure to a selected one of said first and second hydraulic actuator means.

4. The apparatus of claim 1 wherein said support means includes an elongated table for supporting the truss members and said moving means includes a gantry moveable along respective parallel tracks on opposite sides of said table for transporting said roller longitudinally along said table.

5. The apparatus of claim 1 wherein said arresting means includes limit switch means mounted on said moving means and a stop member located at said predetermined position for activating said limit switch means when said limit switch means contacts said stop member, the movement of said moving means being automatically arrested in response to the activation of said limit switch means.

6. The apparatus of claim 1 further including drive means for rotating said roller about its own axis, said drive means including a drive sprocket and a drive chain coupled between said drive sprocket and said roller, said apparatus further including take-up means for taking-up slack in said chain when said roller is lifted.

7. Apparatus of claim 6 wherein said take-up means includes an arm member, first and second idler wheels at respective opposite ends of said arm member and mounting means for pivotally mounting said arm member at a position intermediate with respect to said first and second idler wheels, said first and second idler wheels being in contact with said drive chain to exert tension thereon, said apparatus further including pivot means for pivoting said arm member to maintain said first and second idler wheels in contact with said drive chain and to take up slack in said drive chain when said roller is lifted to said second predetermined position.

8. The apparatus of claim 7 wherein said pivot means includes a spring member coupled to one of said first and second idler wheels for biasing both of said first and second idler wheels in contact with said drive chain.

* * * * *